United States Patent [19]

Martner

[11] 4,034,025

[45] July 5, 1977

[54] ULTRASONIC GAS STREAM LIQUID ENTRAINMENT APPARATUS

[76] Inventor: John G. Martner, 49 James Ave., Atherton, Calif. 94025

[22] Filed: Feb. 9, 1976

[21] Appl. No.: 656,532

[52] U.S. Cl. ..... 261/18 A; 261/62; 261/81; 261/DIG. 48; 239/102

[51] Int. Cl.[2] ..... F02M 27/08

[58] Field of Search ..... 261/DIG. 48, 1, 81, 261/62, 18 A; 239/102, 4; 123/198 E; 417/DIG. 30

[56] References Cited

UNITED STATES PATENTS

| | | | |
|---|---|---|---|
| 1,233,461 | 7/1917 | Freyn | 417/DIG. 30 |
| 2,481,620 | 9/1949 | Rosenthal | 239/4 |
| 2,791,994 | 5/1957 | Grieb | 261/DIG. 48 |
| 2,907,648 | 10/1959 | Chapman | 261/DIG. 48 |
| 2,949,900 | 8/1960 | Bodine | 261/DIG. 48 |
| 3,284,762 | 11/1966 | Kompanek | 261/DIG. 48 |
| 3,357,641 | 12/1967 | Martner | 239/102 |
| 3,393,964 | 7/1968 | Donnelly | 239/4 |
| 3,533,606 | 10/1970 | Thatcher | 261/DIG. 48 |
| 3,544,290 | 12/1970 | Larson, Sr. et al. | 261/78 R |
| 3,756,575 | 9/1973 | Cottell | 261/DIG. 48 |
| 3,804,329 | 4/1974 | Martner | 239/102 |
| 3,814,389 | 6/1974 | August | 261/DIG. 78 |
| 3,857,543 | 12/1974 | McKeen | 261/DIG. 48 |
| 3,893,434 | 7/1975 | Thatcher et al. | 261/DIG. 48 |

FOREIGN PATENTS OR APPLICATIONS

| | | | |
|---|---|---|---|
| 45-17485 | 6/1970 | Japan | 261/DIG. 48 |
| 723,797 | 2/1955 | United Kingdom | 261/DIG. 48 |

*Primary Examiner*—Tim R. Miles
*Attorney, Agent, or Firm*—Flehr, Hohbach, Test, Albritton & Herbert

[57] ABSTRACT

An atomizer assembly includes an ultrasonic resonator which is clamped along a clamping line near one end and driven along a driving line spaced from the clamping line. The atomizer is positioned centrally in a throat for receiving a gas flow at an inlet end and for emitting the gas flow at an outlet end. A gas diffuser is provided for directing the gas flow from the inlet end to contact the surface of the ultrasonic resonator at a high angle of incidence. A liquid flow path is provided through the clamp for directing a liquid to impinge on the vibratory surface of the ultrasonic resonator. The internal surface tension in the liquid is overcome by the vibratory motion and the liquid is cast from the surface of the resonator in atomized form at a low velocity. The atomized liquid is mixed thoroughly with the gas due to the opposing directions of the atomized liquid and the gas flow. The mixed or entrained atomized liquid is passed through the outlet end of the throat.

9 Claims, 5 Drawing Figures

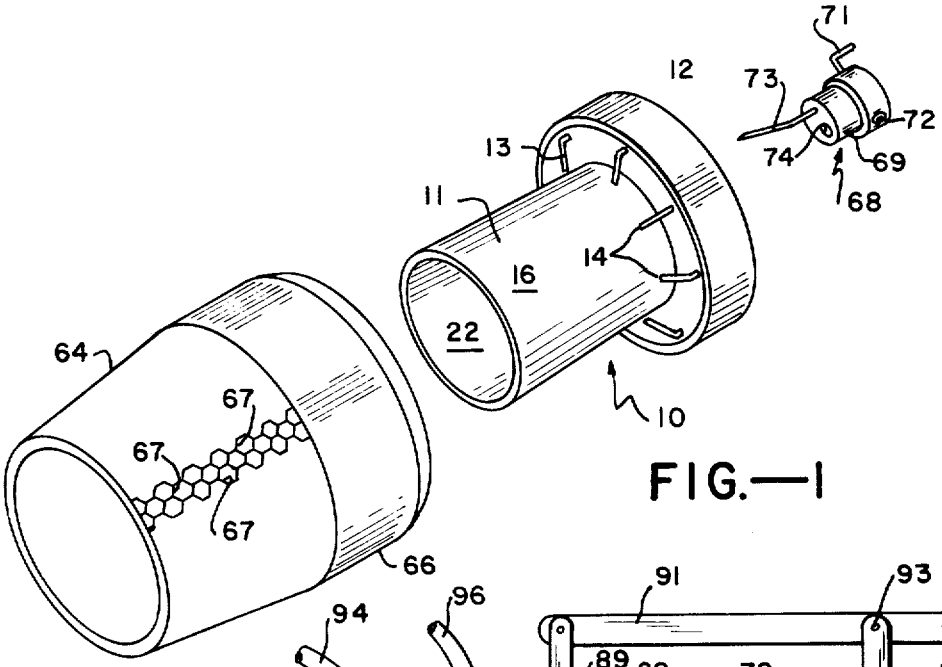
FIG.—1
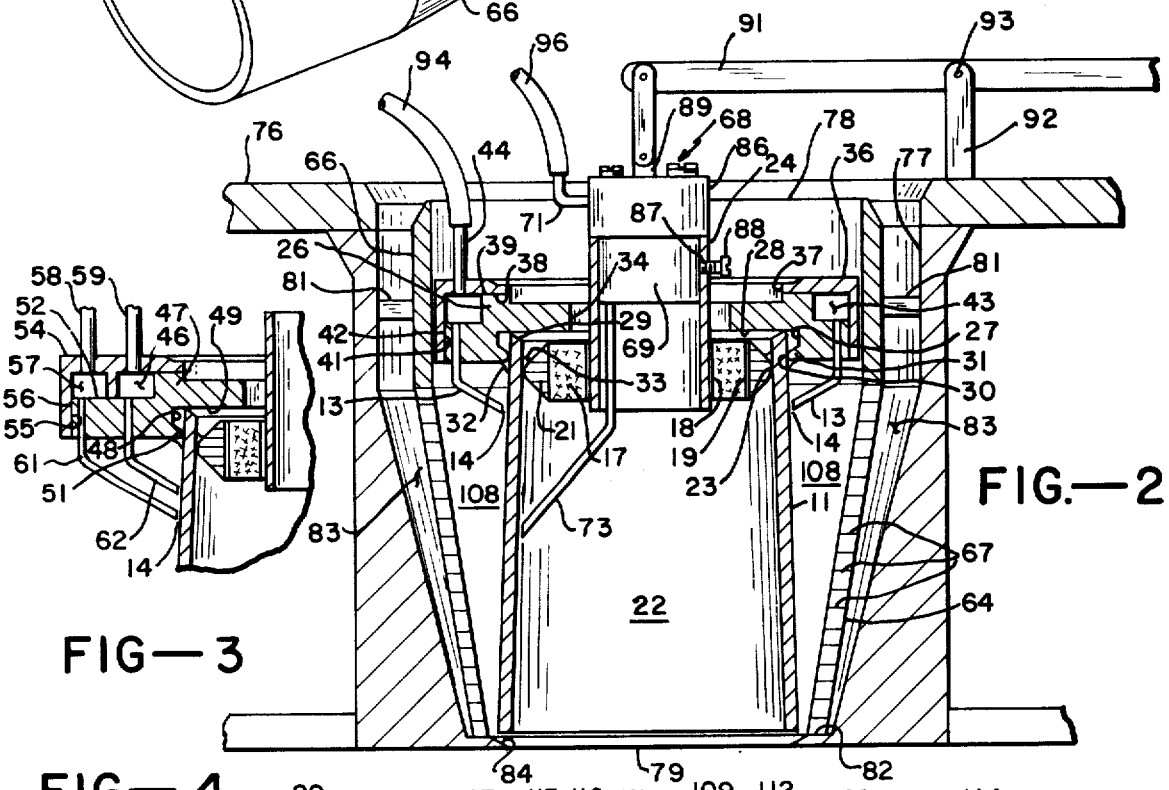
FIG.—2
FIG—3
FIG—4
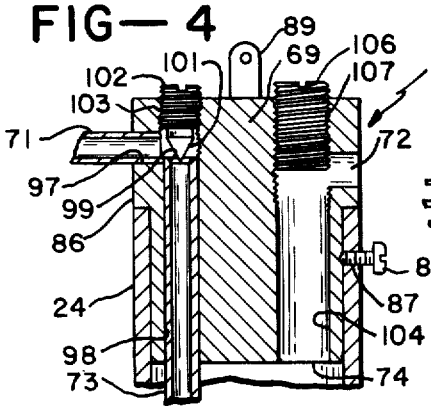
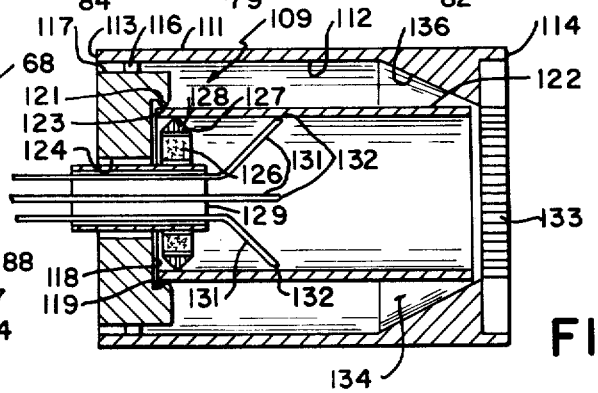
FIG.—5

ULTRASONIC GAS STREAM LIQUID ENTRAINMENT APPARATUS

BACKGROUND OF THE INVENTION

This invention relates to an ultrasonic atomizer for entraining liquids in a gas stream, and more particularly to such an atomizer and associated structure for metering the gas entrained atomized liquid flow therefrom.

Devices presently available for entraining an atomized liquid in a gas stream are typified by currently available carburetors for entraining atomized gasoline in an air stream. Fuel and air is generally improperly mixed in currently available carburetors because the flow of atomized fuel and the air stream tend to stratify due to the high velocity and common direction of flow for both the fuel and the air stream. Moreover, the entrained atomized fuel is subject to removal from the air stream by impingement on mechanical parts located along the air stream path. Also coalescence occurs, wherein small droplets coalesce and form large drops of the atomized liquid due to turbulence in the air stream atomized liquid flow path induced by structural impedances therein. Consequently more entrained liquid is removed from the air stream due to the increased mass of the drops. Normal butterfly valves positioned in the throats of conventional carburetors cause distortion in the fuel entrained air flow, thereby causing a removal of an additional amount of the atomized fuel from the air flow and a deposit of liquid fuel on the walls of the air flow path. Inefficient operation of the device being provided with the fuel air mixture results.

A device is needed which provides an atomized liquid having a low velocity in opposition to the sense of the gas flow velocity for more thorough mixing with a gas stream for entraining the atomized liquid.

SUMMARY AND OBJECTS OF THE INVENTION

In general, the apparatus disclosed herein for entraining atomized liquid in a gas stream includes an outer framework member having a throat for conducting the gas therethrough with an inlet end and an outlet end on the throat. A resonator is disposed in the throat spaced from the throat walls and having resonator surfaces thereon. Means are provided for driving the resonator to assume a resonant vibratory condition. A clamp is provided for engaging one end of the resonator and inducing a vibratory node at the one end. The clamp also serves to position the resonator in the throat. A liquid is delivered through a liquid flow path structure in the device to the surfaces of the resonator, where the liquid is atomized and urged in a direction away from the surface at a relatively low velocity. A diffuser positioned in the throat directs the gas stream in an opposite sense from that of the atomized liquid at a velocity slightly higher than that of the atomized liquid. In this fashion a gas stream which is passed through the throat thoroughly mixes with and entrains the atomized liquid therein.

The method involves driving a vibrating member to assume a resonant vibratory mode and disposing the vibrating member in a flowing gas stream. Thereafter, the liquid to be entrained in the gas stream is deposited on one surface of the vibrating member, thereby atomizing the liquid and casting it from the resonator surface at a relatively low velocity. Further, the method includes directing the gas stream toward the surface of the vibrating member at a velocity having a sense component in opposition to that of the atomized liquid thereby mixing the atomized liquid in the gas stream and avoiding stratification in the gas stream. Thereafter inducing a pressure gradient along the surface of the vibrating member urges the gas-atomized liquid mixture to pass therefrom in the direction of the air stream flow.

In general it is an object of the present invention to provide an apparatus for entraining a liquid in a gas stream which provides for smaller atomized particles in the gas stream.

Another object of the present invention is to provide an apparatus for entraining liquid particles in a gas stream capable of providing relatively high rates of liquid atomization.

Another object of the present invention is to provide structure of a type for entraining engine fuel in an air stream which avoids stratification between the atomized fuel and the air flow.

Another object of the present invention is to provide fuel-air mixtures which are more thoroughly mixed thereby increasing combustion efficiency and reducing the probability of production of combustion pollutants.

Additional objects and features of the invention will appear from the following description in which the preferred embodiment has been set forth in detail in conjunction with the accompanying drawings.

BRIEF DESCRIPTION OF THE DRAWINGS

FIG. 1 is an exploded isometric view of a resonator assembly and diffuser of the present invention.

FIG. 2 is a sectional view showing the subassembly of FIG. 1 in one preferred embodiment.

FIG. 3 is a detail drawing showing a multiple liquid entrainment embodiment of the present invention.

FIG. 4 is a detail drawing showing the idle mixture structure for utilization on the embodiment of FIG. 2.

FIG. 5 is a sectional view of the furnace burner incorporating the disclosed invention.

DESCRIPTION OF THE PREFERRED EMBODIMENT

The apparatus disclosed herein for entraining atomized liquid particles in a gas stream utilizes an ultrasonic generator such as the radially driven tubular atomizer assembly 10 seen in FIG. 1. Resonator tube 11 is shown as a section of constant diameter tube. It should be understood that resonator tube 11 may take any one of a number of shapes; i.e. it may be flared at one end, or take the form of a thin shell of a frustum of a cone. One such shape is described fully in copending patent application Ser. No. 660,262 filed Feb. 23, 1976 for an Ultrasonic Tubular Emulsifier and Atomizer Apparatus and Method, now U.S. Pat. No. 3,986,669. The resonator 11 may also take one of the forms described in U.S. Pat. No. 3,804,329 for an Ultrasonic Generator and Atomizer Apparatus and Method. The preferred embodiment disclosed herein will be described in terms of the apparatus described in copending application Ser. No. 660,262 filed Feb. 23, 1976 above. As stated therein, the optimum design for resonator tube 11 requires that the radial and axial resonant frequencies occur at substantially the same frequency. The resulting reinforcing vibratory modes will provide optimum atomization of a liquid impinging on the vibrating surface of resonator tube 11. Resonator tube section 11 is preferably made of a metal or ceramic material. A clamp 12 surrounds one end of resonator tube section 11. A plurality of conduits 13 extend from the body of clamp 12 to an efflux position 14 overlying the exterior surface 16 of resonator tube section 11.

Turning now to the internal construction of the ultrasonic generator, attention is directed to FIG. 2 of the drawings. A driving piezo-electric element 17 is formed in an annular configuration and polarized radially having electrodes 18 and 19 at inner and outer diameters thereof respectively. A metallic driver ring 21 having a triangular cross section is bonded to the outer diameter of the driving transducer. The metallic ring 21 functions to protect the driving transducer material from fracture and to apply the driving force generated by the driving transducer 17 onto a driver line 23 or narrow region around an inner surface 22 on the resonator tube section 11. A backing ring 24 is bonded to the inside diameter of driver transducer 17 serving as a support for the radial force provided by the driver transducer 17. The backing function is obtained due to the relative stiffness of the backing ring 24 inherent in the smaller mean diameter of the ring relative to the inside diameter of the resonator tube section 11. Backing ring 24 could conceivably be a solid cylindrical section depending on the application in which the ultrasonic resonator is utilized.

Clamp 12 is shown in FIG. 2 having a main clamp body 26 surrounding one end of resonator tube section 11. Main clamp body has an internal bore 27 on one face thereof which is disposed toward resonator tube section 11 in the assembly, and a planar surface 28 at the bottom of internal bore 27. A chamber 29 is formed at the end of resonator tube section 11 which is surrounded by main clamp body 26, so that minimal contact between the end of resonator tube section 11 and surface 28 on main clamp body is obtained. A land 31 is formed on internal bore 27 extending inwardly for contacting the outer surface 16 of resonator tube section 11 at a clamping line 30 therearound which is displaced axially from driver line 23. Land 31 is bonded to outer surface 16 by means of a cement fillet 32 placed therebetween. Driver ring 21 is bonded to the inner surface 22 by means of a cement fillet 33 therebetween. A hole 34 extends through main clamp body 26 for allowing backing ring 24 to pass therethrough in this embodiment.

Clamp 12 may be configured to incorporate a liquid feeding system for delivering a liquid to the outer surface 16 of resonator tube section 11. As seen in FIG. 2 a cover 36 is provided which is cup shaped in configuration having a hole 37 therethrough for allowing passage of backing ring 24 and having a bottom 38 for sealed contact with a face 39 on main clamp body 26. Cover 36 also has an inside diameter 41 for sealed contact with an outside diameter 42 on main clamp body 26. The assembly of cover 36 and main clamp body 26 is seen to provide a sealed chamber 43 which has an annular configuration in this embodiment. Conduits 13 are in communication with annular chamber 43 at one end and are overlying outer surface 16 on resonator tube section 11 proximate thereto at efflux position 14 on the other end. Tube 44 is provided in communication with annular chamber 43 for introducing a liquid thereto.

Turning now to the detail of FIG. 3, clamp 12 is shown having an additional annular chamber 46. Clamp 12 in this embodiment includes a main clamp body 47 having a centrally located internal bore 48 therein with a planar face 49 at the bottom thereof. Bore 48 has formed on the surface thereof a land 51 extending inwardly to contact the outer surface 16 of resonator tube section 11. Additional annular chamber 46 and an adjacent annular chamber 57 provide a pair of chambers which are separately formed by sealable contact between a face 52 on main clamp body 47 and a cylindrical flange 53 on a cover 54 formed to sealably fit around an outside diameter 56 on main clamp body 47. Cylindrical flange 53 serves to separate the annular chambers 46 and 57 as seen in FIG. 3. An inlet tube 58 is provided for introducing a first liquid into annular chamber 57 and another inlet tube 59 is provided for introducing a second liquid into annular chamber 46. A plurality of conduits 61 is provided each having one end in communication with annular chamber 57 and having the other end positioned overlying outer surface 16 of resonator tube section 11 in a position similar to efflux position 14 described above. A plurality of additional conduits 62 is provided each having one end in communication with annular chamber 46 and having the other end in a position overlying outer surface 16 of resonator tube section 11 at a position adjacent to efflux position 14 as seen in FIG. 3. The remainder of the items in FIG. 3 are similar to those recited in the embodiments of FIG. 2 above and like item numbers are assigned thereto.

The manner in which the resonator assemblies 10 of FIGS. 2 and 3 operate will now be described. Driver transducer 17 is radially polarized as described above and provides an oscillatory radial force due to elastic radial expansion and contraction when excited by an oscillatory electrical signal impressed between electrodes 18 and 19. When resonator tube section 11 is clamped at one end and driven at a predetermined radial frequency providing force pulses through driver ring 21 to the driver line 23 displaced from clamping line 30, a node is forced at clamping line 30. Dependent upon the radius of resonant tube section 11 and the length thereof, certain primary resonant frequencies or harmonics thereof are present in the resonator tube 11 depending upon the material from which it is fabricated. When the radial and axial resonant frequencies or harmonics are caused to coincide by proper selection of the physical dimensions discussed above for the resonator tube section 11, and the resonator tube 11 is driven at a frequency which is close to the primary radial and axial resonant frequencies, resonant harmonic modes of vibration are induced in the resonator tube section 11 causing an ultrasonic vibratory mode at the surfaces thereof wherein the radial and axial vibratory modes reinforce one another. The manner in which the resonant radial and axial frequencies reinforce one another and thereby provide an optimum resonant amplitude for efficient atomization of liquid impinging upon the resonating surfaces is fully disclosed in copending application Ser. No. 660,262 mentioned above.

Returning to FIG. 1, a diffuser 64 is shown attached to a ring shaped guide 66. Diffuser 64 is shaped somewhat like a thin walled frustum of a cone with the base attached to one edge of ring shaped guide 66. A plurality of passages 67 pass through the wall of diffuser 64 in a radial direction. Diffuser 64 may be fabricated from a sheet of honeycomb metal having hexagonal apertures therethrough for providing the diffuser passages 67.

In idling assembly 68 shown in FIG. 1 which is formed for positioning centrally in tubular atomizer assembly 10 as hereinafter described. Idler assembly 68 has a body plug 69 and an idle fuel inlet line 71 leading thereto. An idle air input port 72 is formed in one end of plug body 69.

An idle fuel outlet line 73 is shown extending from plug body 69 and an idle air outlet port 74 is shown adjacent to idle fuel outlet line 73 in plug body 69. Fuel inlet line 71 and outlet line 73 are in metered communication and idle air input port 72 and outlet port 74 are also in metered communication as will be hereinafter explained.

Turning again to FIG. 2 of the drawings, an apparatus for entraining liquid particles in a gas stream is shown which takes the form of a carburetor for entraining atomized fuel in an air stream for subsequent delivery to an internal combustion engine. An outer framework 76 is provided which has a throat or passage 77 therethrough with an inlet 78 and an outlet 79. Ring shaped guide 66 is supported near the inlet end 78 by means of posts 81 or some equivalent structure extending between ring shaped guide 66 and the walls of throat 77, but not appreciably obstructing an air stream flow therethrough. As mentioned above, diffuser 64 is bonded to one edge of ring shaped guide 66 and has a conical shape decreasing in diameter toward the outlet end 79 of throat 77. The walls of throat 77 also converge toward the outlet end 79 at a slightly greater rate than the decrease in diameter of diffuser 64 so that a spacing between the walls of throat 77 and the outer surface of diffuser 64 decreases toward the outlet end 79. The smaller diameter end of diffuser 64 rests upon and is attached to a ledge 82 near outlet end 79. An intake chamber 83 is therefore formed between the walls of throat 77 and the outer surface of diffuser 64 having a decreasing cross section as it extends toward outlet end 79. A chamfer 84 extends between outlet end 79 and ledge 82.

Tubular atomizer assembly 10 has idler assembly 68 centrally mounted therein at the inside diameter of backing ring 24 is seen in FIG. 2. A flange 86 is formed on the end of plug body 69 having an outside diameter similar to the outside diameter of backing ring 24. The remainder of plug body 69 has an outside diameter substantially the same as the inside diameter of backing ring 24. Means are provided for retaining plug body 69 in backing ring 24 such as the threaded hole 87 in backing ring 24 for accepting a set screw 88 which bears against plug body 69.

A member extends from one end of plug body 69 for engagement by axial positioning linkage 91. A pivot member 92 attached to framework 76 provides a pivot point 93 for axial positioning linkage 91. It may be seen that when axial positioning linkage 91 is pivoted about pivot point 93, the assembled tubular atomizer assembly 10 and idler assembly 68 is moved axially within the diameter of ring shaped guide 66. A flexible tube 94 is attached to fuel inlet tube 44, and another flexible tube 96 is attached to idle fuel inlet line 71 so that the above axial motion is experienced without interruption of fuel or idle fuel delivery to assemblies 10 or 68.

Turning to FIG. 4, the structural details of idler assembly 68 will now be explained. A passage 97 in plug body 69 is intersected by another passage 98. Passage 97 is formed to accept idle fuel inlet line 71 and passage 98 is formed to accept idle fuel outlet line 73. At the internal end of idle fuel outlet line 73 a needle valve seat 99 is formed for cooperation with a needle valve member 101. Needle valve member 101 is configured for linear adjustment along the extended axis of idle fuel outlet line 73 by means of a threaded end 102 for engaging internal threads 103 in plug body 69. It may be seen that the rate of idle fuel flow through idle fuel outlet line 73 may be adjusted by adjusting the position of needle valve member 101 relative to needle valve seat 99.

An L-shaped passage 104 is also formed through plug body 69 having idle air input port 72 on one end thereof and idle air outlet port 74 on the opposite end thereof. An idle air adjust screw 106 is threadably engaged in a threaded bore 107 for axial adjustment therealong. It may be seen that the cross section of the L-shaped passage may be adjusted by adjusting idle air adjust screw 106 to interpose more or less at the junction of the two legs of the L-shaped passage 104. Thus, the idle fuel air mixture may be set by adjustment of needle valve member 101 and idle air adjust screw 106.

The idle air-fuel mixture is adjusted to obtain a predetermined minimum flow of liquid and gas mixture through the outlet end 79 of throat 77 when the free end of resonator tube section 11 is in contact with chamber 84. Idle fuel outlet line 73 is seen directed to a position immediately adjacent to but spaced from inner surface 22 of resonator tube section 11. Idle fuel introduced into idler assembly 68 through flexible tube 96 and idle fuel inlet line 71 is passed through the metering point provided by needle valve member 101 to be discharged from the end of idle fuel outline 73. The idle fuel impinges upon inner surface 22 of resonator tube section 11 where it is atomized by the vibratory motion thereon and thrown off of inner surface 22 into the chamber formed thereby. Idle air flow passing through L-shaped channel 104 entrains the atomized idle fuel and thereafter carries it through outlet end 79 for sustaining idle running of an engine (not shown) which may be fed from a manifold (not shown) connected to outlet end 79.

The configuration of clamp 12 shown in FIG. 3 allows two different liquids to be fed onto the surface 16 of resonator tube section 11 to thereby form either an atomized mixture of miscible liquids or an emulsion of immiscible liquids. In the case of water injection in a gasoline powered engine, for example, water and gasoline are each delivered through one of the pair of chambers 46 and 57 to form what is thought to be an atomized droplet of water clad in a sheath of gasoline. Burning of the gasoline sheath causes almost instantaneous vaporization of the water droplet and consequent instantaneous expansion which further scatters the gasoline sheath into smaller droplets, thereby increasing the volume of gasoline burned and power obtained from the engine, and reducing unburned pollutants cast off in the engine exhaust.

As tubular atomizer assembly 10 is displaced axially from chamber 84, air enters intake chamber 83 through inlet end 78 and is directed by diffuser 64 through channels 67 to proceed inwardly in a radial direction relative to resonator tube section 11 toward outer surface 16. High velocity air flow entering intake chamber 83 is thereby directed radially inward into a diffusion chamber 108 formed between the inside surface of diffuser 64 and outer surface 16 of resonator tube section 11. Fuel in liquid form introduced into annular chamber 43 through tube 44 transits conduit 13 to be discharged at the efflux position 14 overlying outer surface 16. When resonator tube section 11 is driven into resonance as described above, the liquid fuel is atomized by the vibratory motion of outer surface 16 and thrown off of the surface 16 in a direction substantially orthogonal thereto. The atomized fuel is traveling at a velocity which is lower than the velocity of the air flow directed into diffusion chamber 108 by diffuser passages 67. The airflow entering diffuser chamber 108 approaching outer surface 16 at a high angle of incidence in opposition to the flow sense of the atomized fuel, intermixes and entrains the atomized fuel therein within diffusion chamber 108. Axial position of tubular atomizer assembly 10 as adjusted by axial positioning linkage 91 may be seen to adjust the cross section of the air flow path from diffusion chamber 108 to outlet end 79 of throat 77. The further tubular atomizer assembly 10 is displaced from chamber 84 at outlet end 79 the greater the cross section provided for air flow from diffusion chamber 108 through outlet end 79. The consequent higher fuel air flow rate causes an engine (not shown), for example, to accelerate if sustained from a manifold (not shown) fed from the outlet end 79 of the carburetor device of FIG. 2.

An other embodiment of the disclosed invention is shown in FIG. 5 of the drawings. A tubular atomizer assembly 109 similar to assembly 10 is shown mounted in fixed position inside an outer envelope 111 which serves to provide a passage or throat 112 for the flow of gas such as air therethrough. Outer envelope 111 has an inlet end 113 and an outlet end 114. Inlet end 113 has disposed therein mounting posts 116 for engaging the outer periphery of a clamp 117 in tubular atomizer assembly 109. Clamp 109 has a bore 118 formed in one face thereof having a bottom surface 119 and a land 121 formed on the wall of bore 118. Lane 121 is formed to contact an outer surface on a tubular resonator 122 in the tubular atomizer assembly 109. Land 121 contacts the outer surface of tubular resonator 122 at a clamping line 123 therearound for inducing a vibratory node at the clamping line 123. Clamp 117 has a centrally located hole 124 therethrough.

A radial force generator 126, which may be a piezoelectric crystal which is polarized in a radial direction has a driver ring 127 attached to the outer periphery thereof. Driver ring 127 is formed in this embodiment to assume a triangular cross section, the apex of which contact the inner surface of tubular resonator 122 along a driving line 128 therearound. Force generator 126 is in an annular configuration and has mounted within the central opening therethrough a backing ring 129. Driver ring 127 is bonded to the inside surface of tubular resonator 122 and land 121 is bonded to the outside surface of tubular resonator 122. The clamping line 123 is disposed toward one end of tubular resonator 122 and the driving line 128 is spaced therefrom a predetermined distance. The length of tubular resonator tube 122 and the radius thereof are configured to assume a predetermined ratio therebetween for creating a resonator having similar radial and axial resonant frequencies as explained before. When force generator 126 is driven by an oscillatory electrical signal having a frequency similar to the radial and axial resonant frequencies of tubular resonator 22, the surfaces, inner and outer, thereof assume relatively high vibratory amplitudes due to the reinforcing effect of the radial and axial frequencies excited in the resonator. A plurality of fuel inlet tubes 131 are passed through the inside diameter of backing ring 129 having ends 132 positioned to discharge fuel passing therethrough at a point immediately overlying the inner surface of tubular resonator 122. Fuel impinging upon the inner surface of tubular resonator 122 is atomized as described above and thrown from the inner surface into the chamber formed by the inside surface of tubular resonator 122. Gas or air flow passing through the inside of the backing ring 129 entrains the atomized fuel in the chamber and carries it through a screen 133 at the outlet end 114 of envelope 111 screen 133 functions to block combustion from entering passage 112 or tubular resonator 122.

Air is also passed through the space provided between the outside diameter of clamp 117 and the walls of passage 112. This air passes through the space between the outside surface of tubular resonator 122 and the walls of passage 112 into a constricted space 134 formed by a converging wall 136 positioned near the outlet end 114. Air flow passing outside tubular resonator 122 is thereby accelerated through space 134 to pass through screen 133 thereby joining the entrained fuel-air mixture also passing therethrough from the inside of tubular resonator 122. The resulting fuel-air mixture may be ignited downstream of outlet end 114 to provide apparatus similar to a furnace burner.

An apparatus has been disclosed for atomizing and entraining one or more liquids in a gas stream flow in an efficient manner without noticeable reduction of atomization rate due to loading effects of the liquid on the resonator surface for high flow rates of the liquid onto the resonator.

What is claimed is:

1. Apparatus for entraining liquid particles in a gas stream, comprising an outer framework, said outer framework having a throat therethrough with first and second ends and throat walls extending therebetween, said throat operating to conduct the gas stream therethrough from said first to said second ends, a resonator disposed in said throat spaced from said throat walls and having resonator surfaces thereon, means for driving said resonator to assume a resonant vibratory condition, a clamp engaging one end of said resonator for positioning thereof in said throat, means for delivering a liquid to contact a surface on said resonator, and a diffuser disposed in spaced relations with said resonator surface and forming boundaries of a chamber therewith, said diffuser operating to direct the gas stream into said chamber toward said surface at a first velocity, said resonator operating to atomize the liquid and urge it from said surface into said chamber at a second velocity which is lower than and substantially in opposition to said first velocity, so that the atomized liquid is prevented from passing through said diffuser and is mixed with the gas stream and entrained therein.

2. Apparatus as in claim 1 together with additional means for delivering an additional liquid to contact said resonator surfaces, said resonator operating to atomize said additional liquid, whereby an atomized emulsion of said liquid and additional liquid is formed.

3. Apparatus for entraining liquid particles in a gas stream, comprising an outer framework, said outer framework having a throat therethrough with first and second ends and throat walls extending therebetween, a resonator disposed in said throat spaced from said throat walls and having resonator surfaces thereon, means for driving said resonator to assume a resonant vibratory condition, a clamp engaging one end of said resonator for positioning thereof in said throat, and means for delivering a liquid to contact said resonator surfaces, said resonator operating to atomize the liquid and urge it therefrom at a relatively low velocity, so that when the gas stream is passed over said resonator surfaces the atomized liquid is mixed therewith and entrained therein, said resonator being tubular thereby providing surfaces including interior and exterior resonator surfaces, means coupled to said clamp and resonator for imparting axial motion thereto in said throat, the gas stream entering said first throat end and exiting said second throat end, said second end being smaller in cross section than said resonator, whereby axial motion of said resonator toward said second end reduces the gas flow cross section and thereby the gas flow, said resonator axial motion thereby performing a throttling function, and a diffuser disposed between said resonator and said throat walls for directing the entering gas stream toward said exterior resonator surfaces.

4. Apparatus as in claim 3 together with an idler assembly mounted centrally in said clamp having a first passage therethrough for passing a predetermined flow of the liquid to impinge on said interior resonator surfaces, said idler assembly having a second passage therethrough for admitting a predetermined flow of gas to the interior of said resonator, whereby a predetermined minimum flow of liquid and gas mixture passes through the second end of said throat for all axial positions of said resonator in said throat.

5. Apparatus as in claim 4 together with means for adjusting the predetermined flow of liquid and means for adjusting the predetermined flow of gas, whereby said predetermined minimum flow of liquid and gas mixture is adjusted.

6. Apparatus for providing a controlled flow of atomized liquid entrained in a gas stream, comprising a throat member having throat walls forming a passage therethrough with an inlet end and an outlet end, an annular diffuser member mounted in said passage spaced from said throat walls at said inlet end and adjacent said throat walls at said outlet end, thereby forming an intake chamber therebetween, a tubular resonator disposed within said annular diffuser member and forming a diffusion chamber therebetween, a clamp for engaging one end of said tubular resonator, means for driving said tubular resonator in a vibratory mode, means coupled to said resonator for imparting axial motion thereto, the axial position of said resonator being determinative of the gas stream flow cross section between said diffuser chamber and said outlet end, whereby said diffusion chamber is controllably communicated with said outlet end, and means for directing a liquid to impinge on the surface of said tubular resonator so that the liquid is atomized by said vibratory mode and thrown therefrom into said diffusion chamber, whereby the gas stream transits said inlet end, said intake chamber, said diffuser, said diffuser chamber, entrains the atomized liquid therein, and emerges through said outlet end.

7. Apparatus as in claim 6 wherein said annular diffuser comprises a plurality of radial channels having an axial orientation for directing the gas stream toward the surface of said tubular resonator at a high angle of incidence therewith substantially in opposition to the direction urged in the atomized liquid, thereby efficiently entraining the atomized liquid in the gas stream in said diffusion chamber.

8. Apparatus as in claim 6 wherein said tubular resonator has internal and external surfaces and said clamp engages said external surfaces, said clamp having a centrally located hole therethrough and said outlet end of said throat being in communication with the interior of said tubular resonator, together with an idle distributor disposed within said centrally located hole, said idle distributor having a first passage therethrough for admitting a predetermined flow of liquid to impinge on said internal surfaces and a second passage therethrough for admitting a predetermined flow of gas to the interior of said tubular resonator, whereby a predetermined minimum flow of atomized liquid entrained in the gas stream passes through said outlet end for all axial positions of said tubular resonator.

9. Apparatus as in claim 8 together with means for adjusting the size of said first and second passages whereby said predetermined minimum flow is adjusted.

* * * * *